US006593829B2

(12) United States Patent
Oldfield et al.

(10) Patent No.: US 6,593,829 B2
(45) Date of Patent: Jul. 15, 2003

(54) MICROSTRIP DOT TERMINATION USABLE WITH OPTICAL MODULATORS

(75) Inventors: William Oldfield, Redwood City, CA (US); Karam Noujeim, Mountain View, CA (US)

(73) Assignee: Anritsu Company, Morgan Hill, CA (US)

( * ) Notice: Subject to any disclaimer, the term of this patent is extended or adjusted under 35 U.S.C. 154(b) by 0 days.

(21) Appl. No.: 09/947,480

(22) Filed: Sep. 6, 2001

(65) Prior Publication Data

US 2003/0048146 A1 Mar. 13, 2003

(51) Int. Cl.[7] ..... H01P 1/26
(52) U.S. Cl. ..... 333/22 R; 359/327
(58) Field of Search ..... 359/22 R, 81 A, 359/327

(56) References Cited

U.S. PATENT DOCUMENTS 4,291,415 A * 9/1981 Buntschuh ..... 333/26
5,513,390 A * 4/1996 Vice ..... 327/113
5,686,872 A * 11/1997 Fried et al. ..... 320/109
6,044,097 A * 3/2000 Kawamura et al. ..... 372/38.01

FOREIGN PATENT DOCUMENTS

JP 0279601 * 11/1989 ..... 333/22 R

OTHER PUBLICATIONS

Oldfield Bill, "Connector and Termination Construction above 50 Ghz," Applied Microwave & Wireless Magazine, Apr. 18, 2001, pp. 56, 58, 60, 62, 64 and 66, Nobel Publishing.

* cited by examiner

*Primary Examiner*—Robert Pascal
*Assistant Examiner*—Stephen E. Jones
(74) *Attorney, Agent, or Firm*—Fliesler Dubb Meyer & Lovejoy LLP

(57) ABSTRACT

A dot termination comprising a disk of thin film resistive material connects a transmission line on a substrate to a DC ground plane in a manner to provide broadband high frequency performance. The dot termination connects to DC ground connections spaced about the perimeter of the disk. Each DC connector includes a ground via passing through the substrate to the ground plane. A metal trace is used for each DC connection, the trace connecting a respective via with the perimeter of the disk. Each metal trace can include a resistive portion connected to the dot region and a metal trace portion connecting the trace to the via. A resistive extension tongue of the disk connects the disk to a transmission line trace.

22 Claims, 9 Drawing Sheets

- Prior Art -

- Prior Art -

- Prior Art -

- Prior art -

- prior art -

MICROSTRIP DOT TERMINATION USABLE WITH OPTICAL MODULATORS

FIELD OF THE INVENTION

The present invention relates generally to microstrip terminations, and to terminations used with optical modulators.

BACKGROUND

Terminations are common components in most microwave systems. Microstrip terminations are easy to manufacture using thin film technology, but the performance typically drops off rapidly with increasing frequency. Thin film technology typically uses an alumina substrate, with gold and resistor material sputtered onto it and then patterned with photolithography techniques to define microstrip transmission line traces and resistors. Thick films could also be used, but the thick film resistors do not function well at high frequencies (above 20 GHz).

FIG. 1 illustrates one standard microstrip termination, known as an edge ground circuit. In the microstrip 100 of FIG. 1, a microstrip transmission line 104, typically a metal line, is formed on the microstrip substrate 102, made of a dielectric such as alumina. An area of resistive material 106 is formed on the substrate 102 along the transmission line 104 near an edge ground. The edge ground is formed with a transmission line trace 110 connecting the resistive material 106 to the metal plated edge 108 which connects to a metal ground region 112 deposited on the bottom surface of the substrate. The resistive material 106 is used to terminate a signal propagating along the transmission line by matching the impedance of the transmission line and preventing reflection of the propagating signal.

FIG. 2 illustrates another microstrip termination typically used when grounding is desired away from a substrate edge. This termination 200 also includes a microstrip substrate 202 typically having a metal bottom layer 212, a transmission line 204, and an area of thin film resistive material 206. The substrate 202 also has a via 210 between the ground side of the resistor 206 and the bottom metal of the substrate 202. The substrate 202 often contains Monolithic Microwave Integrated Circuits (MMICs) connected to the transmission line 204 and the substrate 202 is often mounted on a carrier. A carrier is typically a thin metal plate, on the order of ½ to 1 mm thick, and provides the ground for the microstrip substrate and the MMICs thereon in addition to the metal bottom layer 212.

This termination of FIG. 2 further uses a ground via 210. The via 210 is formed from metal deposited in a hole in the substrate that extends from the area of metal 208 on the top surface of the substrate to the metal bottom layer 212. The termination shown in FIG. 2 can be placed anywhere in a subsystem circuit, but the performance is generally worse than the edge ground circuit of FIG. 1. The poor performance is due to the increased inductance to ground resulting from the small via.

A microstrip termination that provides acceptable performance at high frequencies over a wide bandwidth, but not at low frequencies or to DC, is the dot termination. Dot terminations are high return loss terminations capable of performing adequately at high frequency and over a wide bandwidth. Dot terminations typically do not require a ground. FIG. 3 shows a dot resistor 300 of the prior art. This dot resistor 300 typically includes a circular area of thin film resistive material 302. The circular area of resistive material

302 typically has a protruding region of resistive material, or tongue 304, which extends from the circular area and into contact with a metal trace 306 forming a transmission line. The thin film resistive material of the tongue 304 extends under the metal trace 306, assuring an overlap or connection between the metal trace 306 and the resistive tongue 304.

The resistance of the resistive material is typically about 50 ohms per square. Ohms per square is a unit of measure known and used in the art to describe the surface resistivity of a material, typically measured with a four point probe. With the four point probe, the resistance is measured by passing a fixed current though two points and measuring the voltage at the other two points. By controlling the input current, the surface resistance equals the voltage across the pair of test points, such that the units of distance drop out.

The size of the circular area, or "dot", determines the low frequency limit of the termination. Dot diameters up to 15 times the trace width will typically perform to the upper frequency limit of a microstrip. Minimum dot diameters are typically at least three times the trace width. As an example, Table 1 shows the appropriate 20 dB and 15 dB low end frequencies of various dot sizes on a 10 mil alumina substrate.

TABLE 1

Frequency v. dot size

| Dot diameter | 20 dB Frequency GHz | 15 dB Frequency GHz |
|---|---|---|
| 1.2 mm | 15 | 11 |
| 2.0 mm | 11 | 8 |
| 2.5 mm | 10 | 7 |
| 4.0 mm | 9 | 3 |

The typical return loss performance of a dot termination at high frequencies, such as up to about 110 GHz, is better than 25 dB.

SUMMARY

In accordance with the present invention, a dot termination composed of a circular thin film resistive material connects a transmission line to a ground plane in a manner to provide a broadband high frequency performance that also goes to DC. The dot termination can use traces provided around the perimeter of the dot resistive material with vias connecting the traces to ground to provide multiple DC paths to ground. Each trace is formed with a metal portion connecting each ground via to a resistive trace portion which connects to the resistive dot material. A resistive tongue trace connects the dot material to a metal trace forming a transmission line providing a signal to the dot termination. The use of multiple DC ground paths allows the DC resistance to be approximately 50 Ω without destroying the high frequency performance.

In accordance with the present invention, the dot termination can be used in a shunt configuration with an optical modulator to provide voltage biasing for the optical modulator. To maximize the biasing voltage, a DC blocking capacitor can be placed between the dot termination and ground. Biasing current can be applied at the connection of the dot termination and the optical modulator. Preferably to enhance performance, biasing current is applied between the dot termination and the blocking capacitor.

BRIEF DESCRIPTION OF THE DRAWINGS

The invention will be described with respect to particular embodiments thereof, and reference will be made to the drawings, in which.

DETAILED DESCRIPTION

I. Dot Termination with DC Ground

A microstrip termination in accordance with the present invention utilizes a dot termination with a DC ground path. The addition of the DC ground path allows acceptable performance down to DC. But, simply providing a DC path to ground may not satisfy all desirable performance requirements.

One disadvantage with providing a single DC path to ground may be that the resistance value of the dot termination will no longer be appropriate, i.e., at a value other than 50 Ω. For example, a dot termination in microwave devices typically requires an ohms per square value of approximately 50 ohms. But, a circular area of 50 ohms per square resistive material will provide a value of about 75 ohms when a DC path to ground is provided.

II. Dot Terminations with Multiple Perimeter DC Terminations

To overcome these disadvantages, in accordance with the present invention, a dot termination is provided using multiple DC ground connections near the perimeter of the disk. In one embodiment of a dot termination 400, shown in FIGS. 4 and 5, four DC ground connectors are spaced about the perimeter of the resistive disk 402, although the number and separation of the ground connectors may vary in other embodiments.

Figure 1:
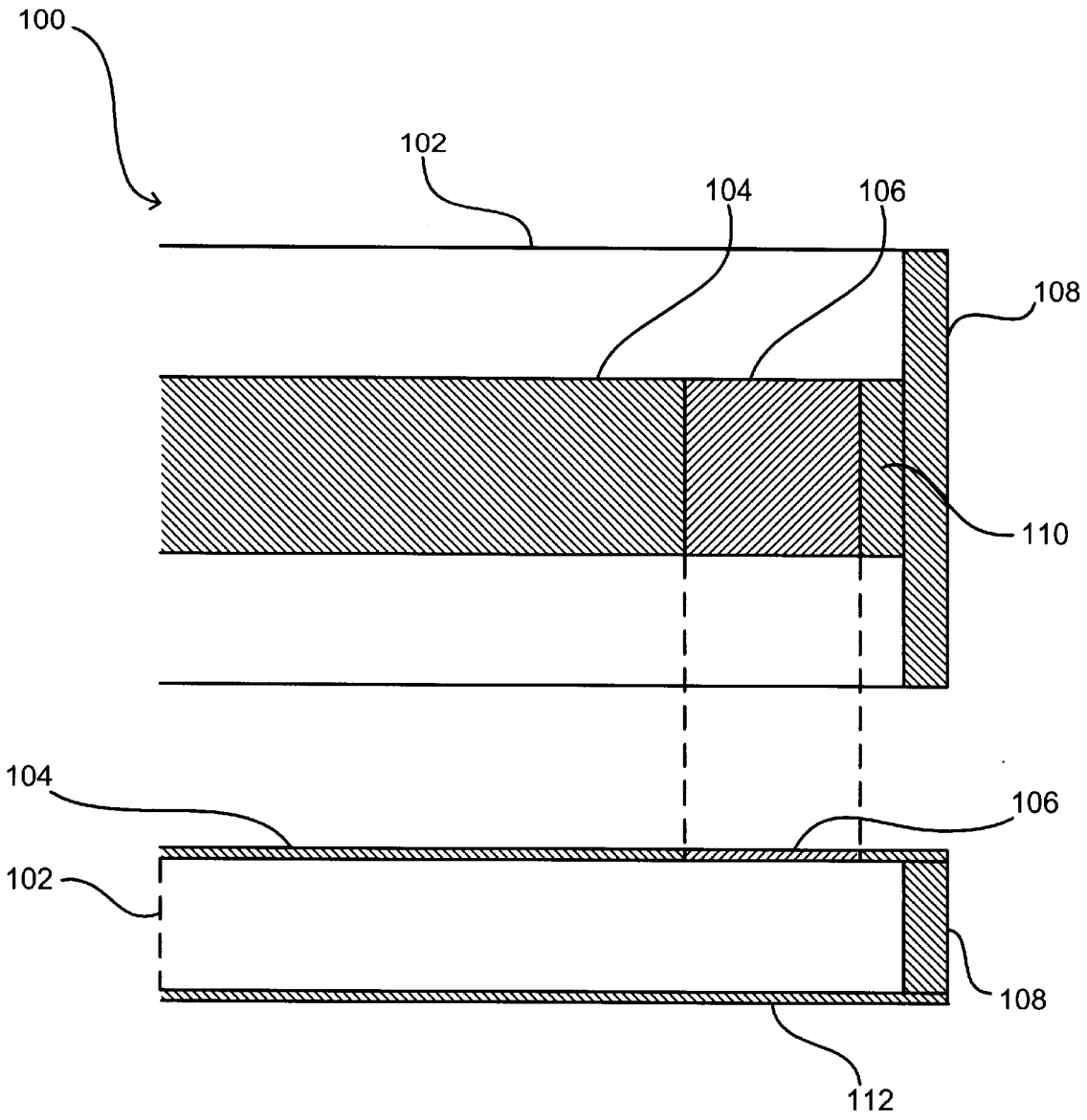
FIG. 1 is a front and side view of a prior art microstrip termination.
Figure 2:
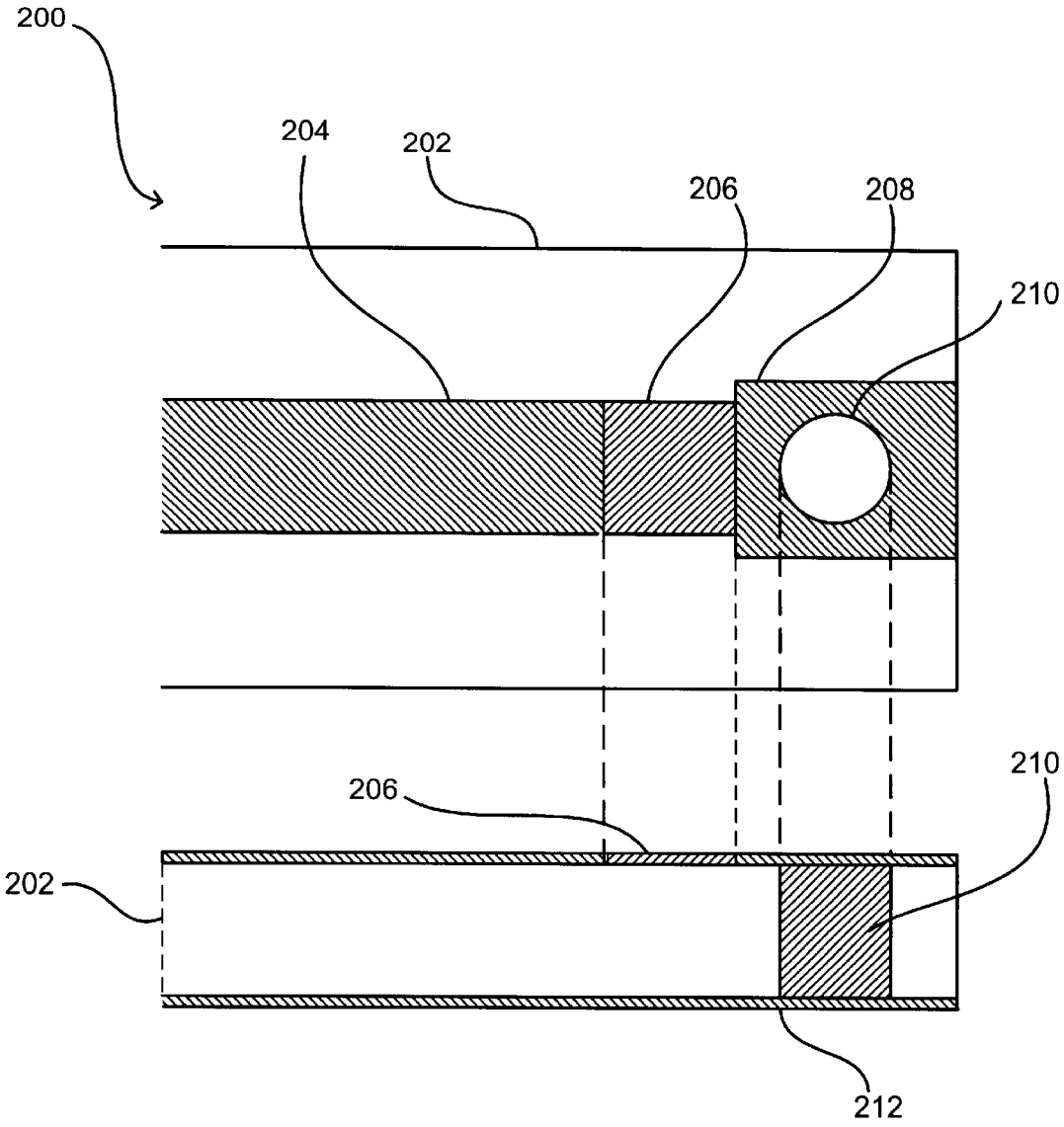
FIG. 2 is a front and side view of another prior art microstrip termination.
Figure 3:
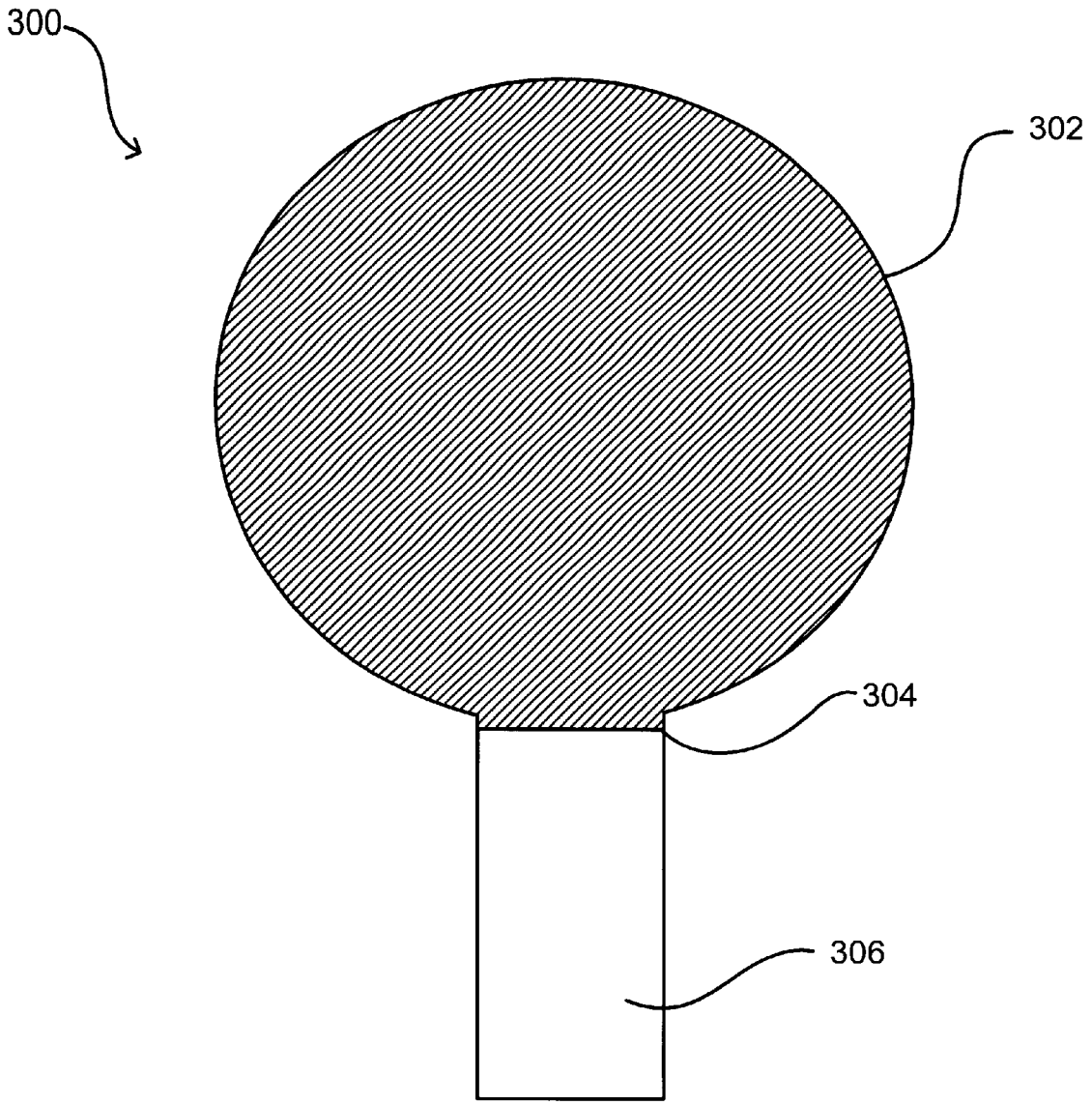
FIG. 3 is a front view of a prior art dot termination.
Figure 4:
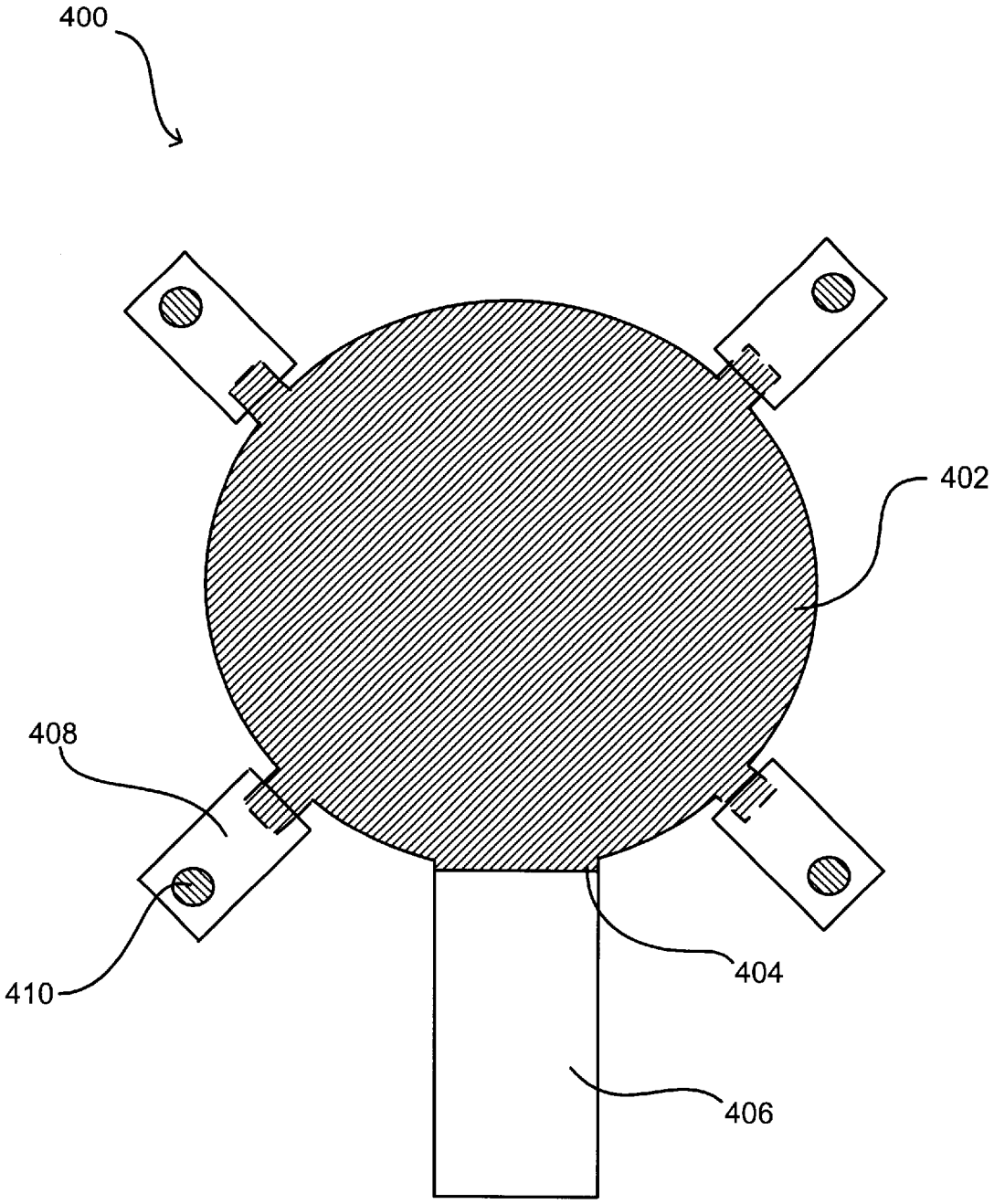
FIG. 4 is a front view of a dot termination in accordance with one embodiment of the present invention.
Figure 5:
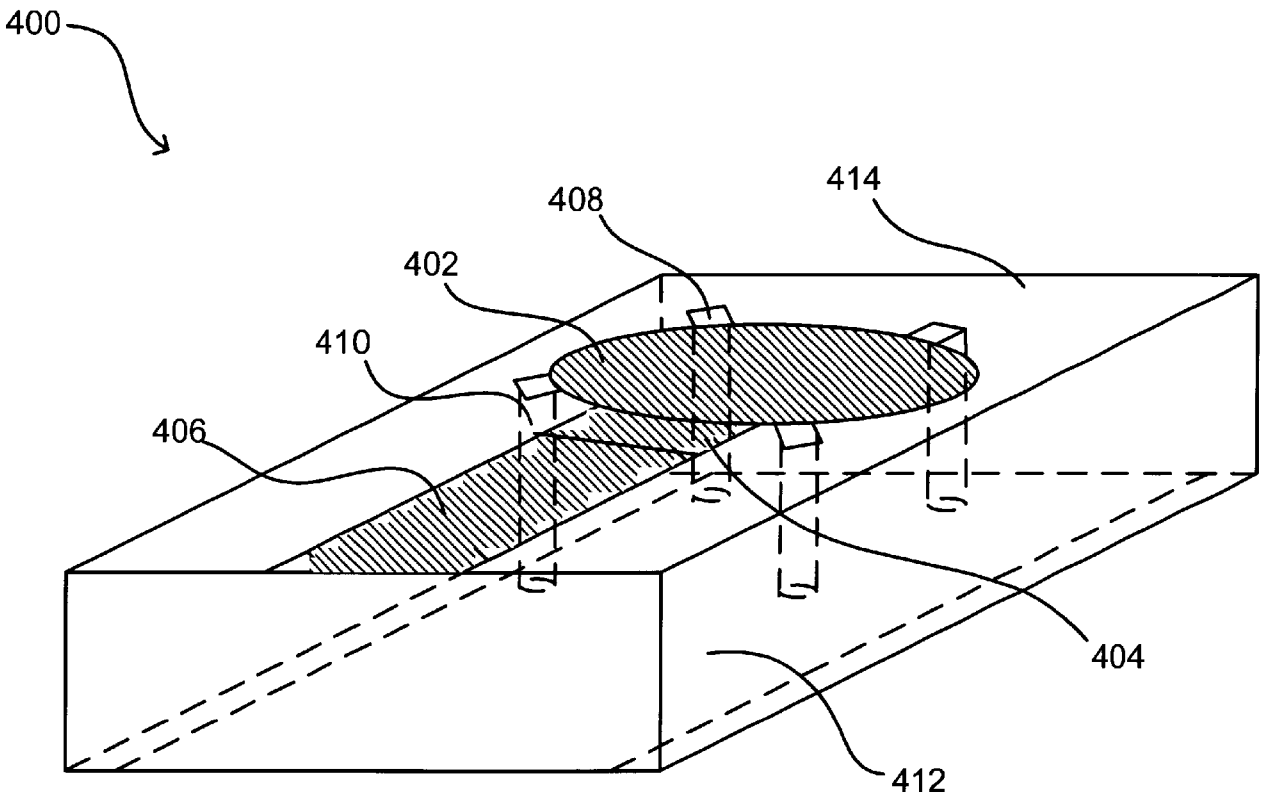
FIG. 5 is a perspective view of the dot termination of FIG. 4, shown on a portion of a substrate.

The DC ground connections in FIGS. 4 and 5 each include a ground via, such as 410, passing through the substrate 414 to a ground plate 412. A metal trace, such as 408, is then used for each DC connection, the traces connecting a respective via, such as 410, with the perimeter of the disk 402. The metal traces, such as 408, can include a resistive portion connected to the dot region 402 and a metal trace portion connecting the trace to the via. As with typical dot terminations, a resistive extension tongue 404 of the disk connects the disk to a transmission line trace 406.

The location of the DC connections is not extremely critical. Optimal RF performance may be obtained, however, by placing the connections about the disk as shown in FIG. 4. The connections are slightly asymmetrical, which reduces the combining effects of mismatches created by the connections. More or fewer connections maybe used, but changing the number of connections may degrade performance slightly.

Figure 9:
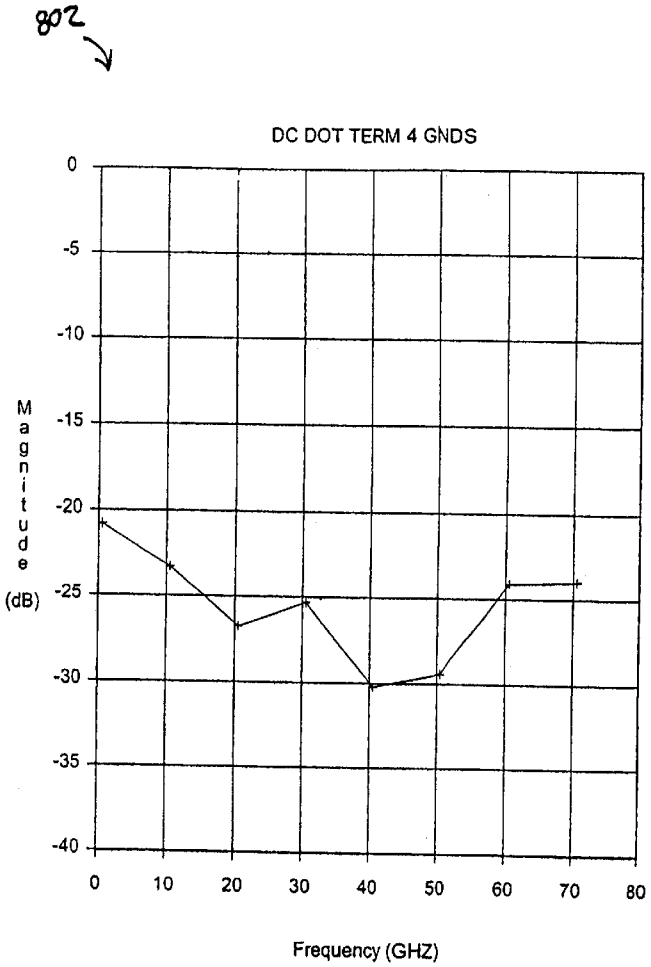
FIG. 9 is a graph comparing performance of a dot termination of the prior art with a dot termination in accordance with one embodiment of the present invention.
Figure 9:
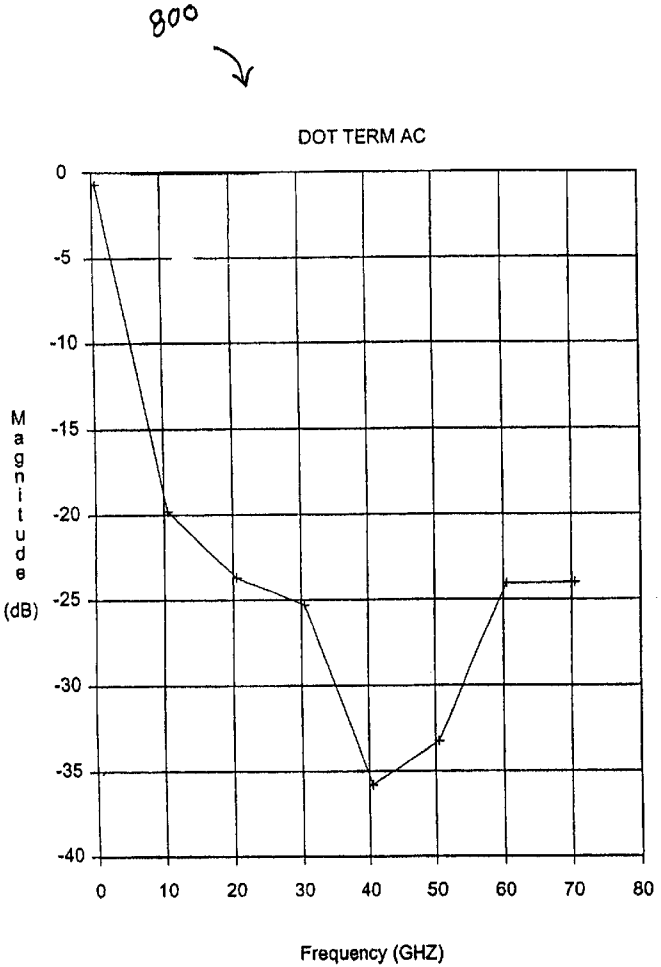

The diameter of the dot resistor may be chosen by first determining the lowest frequency for which performance is needed. Typically, the optimal dot diameter is about 10 times the trace width, but may vary by embodiment and application. The choice of resistive material may depend upon the application. For example, a single-sided microstrip substrate may require 50 ohms per square +/−10%. A suspended substrate with traces on both sides, however, may use 100 ohms per square. FIG. 9 shows the performance of the DC dot termination 802 compared to a standard dot termination of the prior art 800.

III. Optical Modulator with Dot Termination

Figure 6:
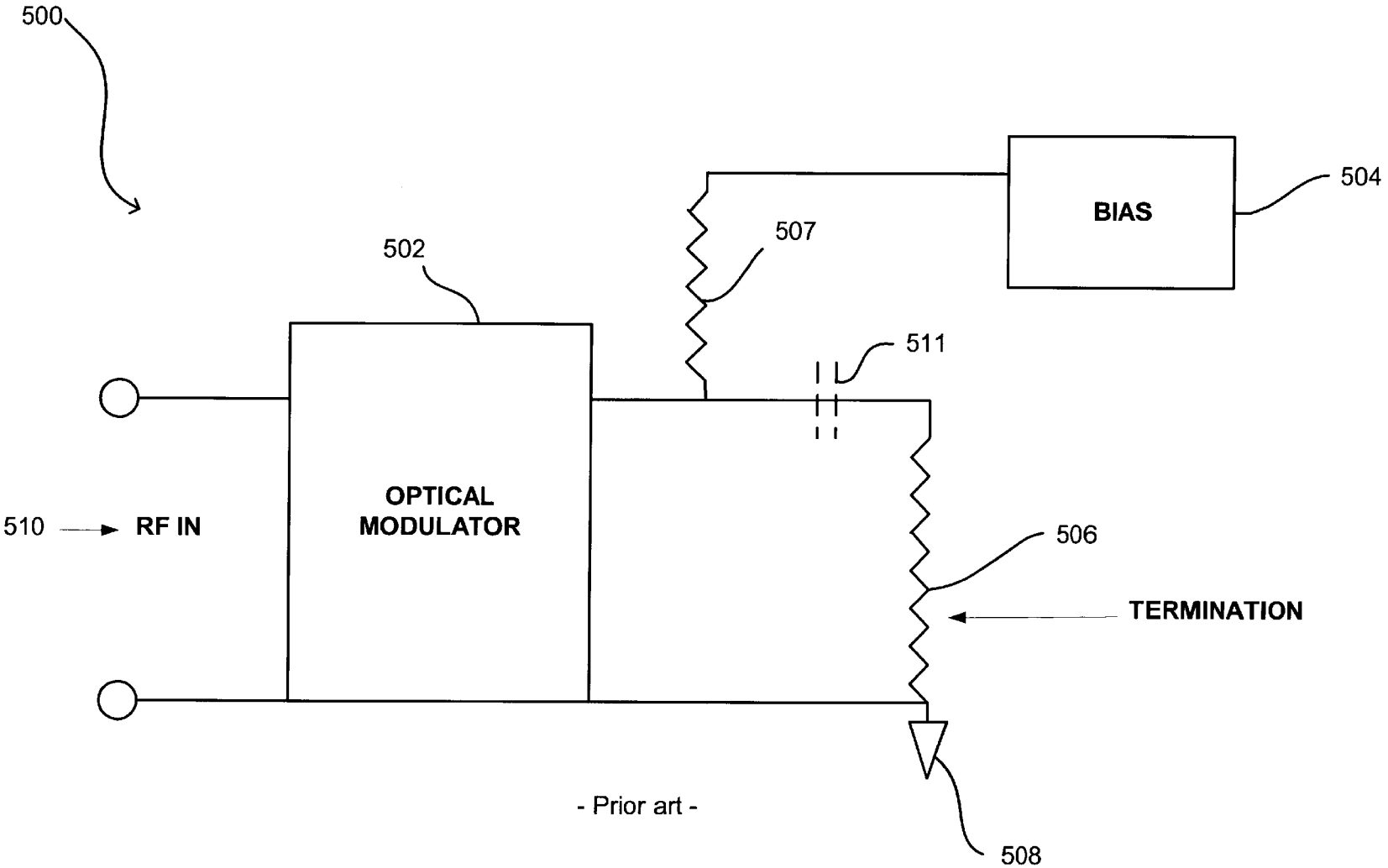
FIG. 6 is a diagram of an optical modulator system of the prior art.

A dot termination in accordance with the present invention maybe useful in high frequency applications, such as for bias systems for optical modulators. An optical modulator as shown in FIG. 6 is generally a voltage-controlled device, which typically does not require a high current. A bias voltage may be provided from bias circuit 504. The bias circuit can be a simple inductor connected to the RF trace forming a choke providing a current through resistor 507. The termination 506, because it is parallel with the modulator, determines the voltage across the optical modulator 502.

The RF comes into the optical modulator 502 through transmission line 510. The system 500 is terminated by resistor 506 and grounded at 508. The voltage developed across the modulator 502 is typically only as great as the voltage developed across the termination 506. If the bias line resistor 507 is a high value resistor, most of the bias voltage is dropped across that resistor and not the termination resistor 506, so little voltage is available to bias the modulator. A DC blocking capacitor, shown by the dotted lines 511 in FIG. 6, may be placed in front of the termination 506 to solve the problem. DC blocks, however, are typically difficult to make over a broad bandwidth. To overcome the DC block bandwidth requirements to some degree, a dot termination may be used in place of termination 506. Low frequency performance, however, may be unacceptable.

Figure 7:
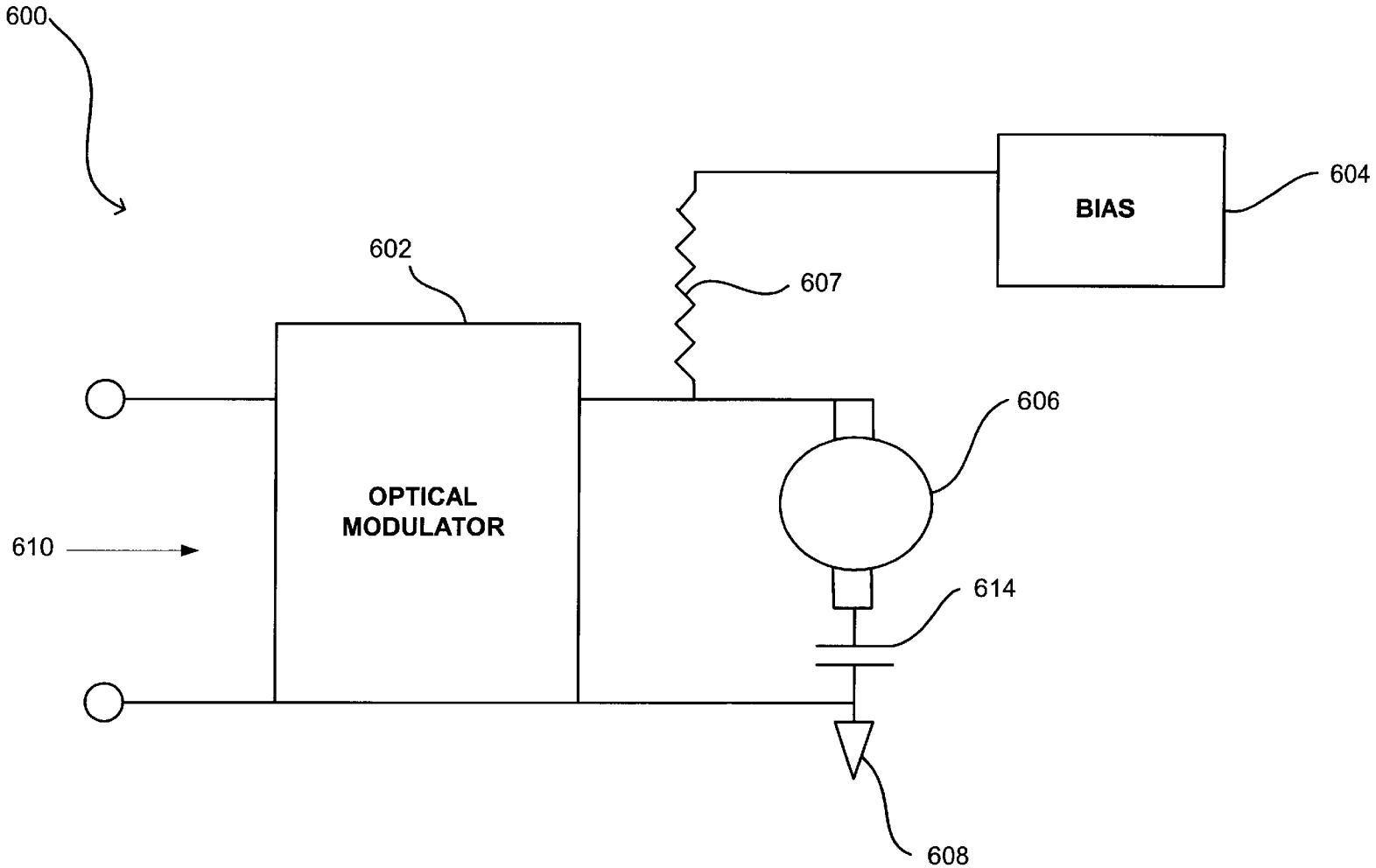
FIG. 7 is a diagram of an optical modulator with a DC dot termination in accordance with one embodiment of the present invention.

An even better solution to the bandwidth problem is to use the aforementioned DC dot termination as shown in the system 600 of FIG. 7. Instead of having the DC go directly to ground 608, a substantial bias voltage maybe maintained across the dot termination using a bypass DC block 614 connected between the dot termination and ground. The use of a bypass DC block 614 will typically only affect the low frequency performance of the DC dot termination 606. A DC blocked termination may be obtained, for this embodiment, with good RE performance from about 50 kHz to about 90 GHz. The dot termination can be grounded through a blocking capacitor using a single trace extending from the dot, as illustrated in FIG. 7, or by multiple capacitors placed in multiple traces around the perimeter of the dot, similar to the configuration shown in FIG. 4. But, if the configuration of FIG. 4 is used, all vias must be DC blocked.

Figure 8:
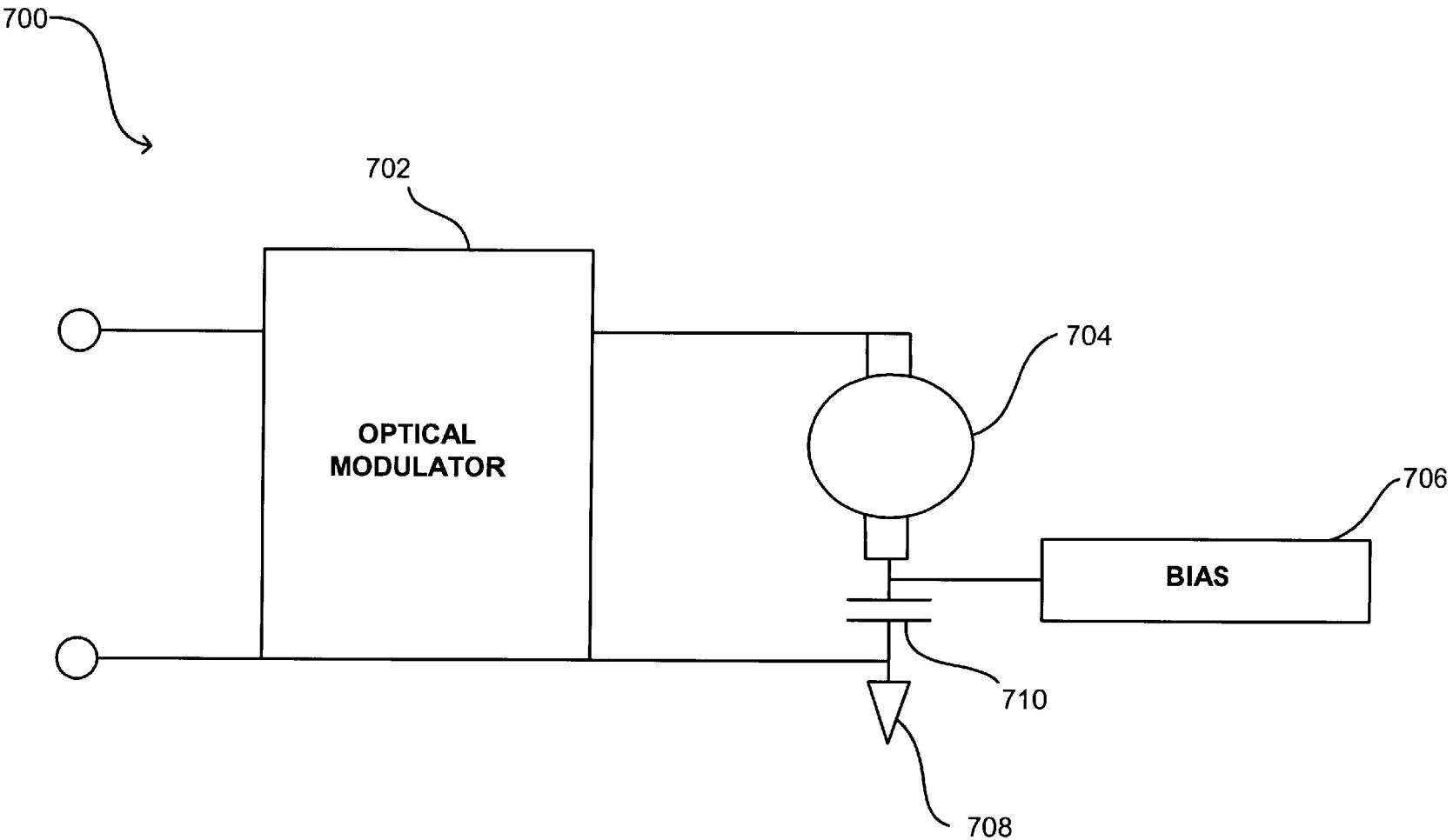
FIG. 8 is a diagram of another embodiment of an optical modulator with a dot termination in accordance with the present invention.

In another embodiment of a system 700 having an optical modulator 702, the bias 706 is applied at the DC block 710, as shown in FIG. 8. The DC block 710 is at virtual ground in this embodiment, and adding bias in this area may have no effect on the RF performance. Since current is limited in this embodiment only by the resistance of the dot termination 704 and not by a high value bias resistor, high currents may be delivered to the RF line. Again, bias current can be delivered through a single trace to the dot, or through multiple traces, similar to that shown in FIG. 4. Table 2 shows current values for various voltages using the system of FIG. 8, as well as an embodiment employing a 1000 ohm bias resistor.

TABLE 2

| Current differences for different voltages and bias resistors | | | |
|---|---|---|---|
| Voltage | 3 Volts | 6 volts | 10 volts |
| 50 ohm bias resistor | 60 ma | 120 ma | 200 ma |
| 1000 ohm bias resistor | 3 ma | 6 ma | 10 ma |

Although the system shown in FIGS. 7 and 8 uses an optical modulator (602 and 702) to drive the dot termination 606 and 704, high frequency signal generators other than optical modulators 602 and 702 might be used. The dot terminations 606 and 704 will still function in the configuration shown to provide improved performance in microwave applications.

Although the present invention has been described above with particularity, this was merely to teach one of ordinary skill in the art how to make and use the invention. Additional modifications will fall within the scope of the invention, as that scope is defined by the following claims.

What is claimed is:

1. A high frequency system requiring a termination, comprising:

a high frequency signal generator adapted to receive an RF signal;

a dot termination connected in shunt with the high frequency signal generator; and a current bias source connected to provide current to a terminal of the dot termination.

2. The high frequency system of claim 1 further comprising:

a DC blocking capacitor connecting the terminal of the high frequency signal generator to ground.

3. The high frequency system of claim 1 further comprising:

a DC blocking capacitor coupling the terminal of the dot termination to the high frequency signal generator.

4. The high frequency system of claim 1, wherein the dot termination comprises:

a substrate having a top surface and a bottom surface, with a transmission line forming the first terminal of the dot termination provided on the top surface, and a metal ground plane region provided on the bottom surface; and a circular area of resistive material on the top surface of said substrate, said circular area having a first tongue portion extending from said circular area and contacting the transmission line, and a second trace portion extending from the circular area and coupled to the metal ground region on the bottom surface of the substrate.

5. The high frequency system of claim 4 further comprising:

a DC blocking capacitor coupling the transmission line to the high frequency signal generator.

6. The high frequency system of claim 1, wherein the dot termination comprises:

a substrate having a top surface and a bottom surface, with a first transmission line forming the first terminal of the dot termination provided on the on the top surface, and a metal ground plane region provided on the bottom surface;

a circular area of resistive material on the top surface of said substrate, said circular area having a first resistive tongue portion extending from said circular area and contacting the transmission line, and a second resistive trace portion extending from the circular area and coupled to a second transmission line;

a metal ground region on the bottom surface of the substrate coupled to the second transmission line; and a DC blocking capacitor coupling the first transmission line to the metal ground region on the bottom surface of the substrate.

7. An optical modulator system, comprising:

an optical modulator adapted to receive an RF signal;

a dot termination connected in shunt with the optical modulator; and a current bias source connected to provide current to a terminal of the dot termination.

8. The optical modulator system of claim 7 further comprising:

a DC blocking capacitor connecting the terminal of the optical modulator to ground.

9. The optical modulator system of claim 7 further comprising:

a DC blocking capacitor coupling the terminal of the dot termination to the optical modulator.

10. The optical modulator system of claim 7, wherein the dot termination comprises:

a substrate having a top surface and a bottom surface, with a transmission line forming the first terminal of the dot termination provided on the on the top surface, and a metal ground plane region provided on the bottom surface;

a circular area of resistive material on the top surface of said substrate, said circular area having a first tongue portion extending from said circular area and contacting the transmission line, and a second trace portion extending from the circular area and coupled to the metal ground region on the bottom surface of the substrate.

11. The optical modulator system of claim 10 further comprising:

a DC blocking capacitor coupling the transmission line to the optical modulator.

12. The optical modulator system of claim 7, wherein the dot termination comprises:

a substrate having a top surface and a bottom surface, with a first transmission line forming the first terminal of the dot termination provided on the on the top surface, and a metal ground plane region provided on the bottom surface;

a circular area of resistive material on the top surface of said substrate, said circular area having a first resistive tongue portion extending from said circular area and contacting the transmission line, and a second resistive trace portion extending from the circular area and coupled to a second transmission line;

a metal ground region on the bottom surface of the substrate coupled to the second transmission line; and a DC blocking capacitor coupling the first transmission line to the metal ground region on the bottom surface of the substrate.

13. A dot termination, comprising:

a substrate having a top surface and a bottom surface, said substrate having a transmission line on the top surface;

a circular area of resistive material on the top surface of said substrate, said circular area having a short tongue portion extending from said circular area and contacting the transmission line;

a plurality of conductive ground vias extending from the top surface to the bottom surface of said substrate, the ground vias positioned about, and separated from, said circular area of resistive material;

a conductive ground trace for each of said plurality of ground vias, each conductive ground trace extending from a respective ground via toward said circular area of resistive material; and an extension of resistive material for each said ground trace, each extension of resistive material extending from said circular area of resistive material to a region underneath a respective said ground trace.

14. The dot termination of claim 13, wherein the resistive material comprises a thin film resistive material.

15. The dot termination of claim 13, wherein the substrate comprises alumina.

16. The dot termination of claim 13, wherein said circular area of resistive material has a resistance of about 50 ohms per square.

17. The dot termination of claim 13, comprising four ground vias.

18. The dot termination of claim 13, wherein said ground vias are spaced asymmetrically about said circular area of resistive material.

19. The dot termination of claim 13, wherein metal plating on at least a portion of the bottom surface of the substrate electrically connects to each of the plurality of ground vias.

20. The dot termination of claim 13, wherein metal plating is provided on at least a portion of the bottom surface of the substrate beneath the transmission line, forming a microstrip transmission line, and the metal plating on the bottom surface further electrically contacts each of the plurality of ground vias.

21. An optical modulator system comprising:

an optical modulator adapted to receive an RF signal;

a dot termination connected in shunt with the optical modulator, comprising:

a substrate having a top surface and a bottom surface, with a first transmission line forming the first terminal of the dot termination provided on the on the top surface, and a metal ground plane region provided on the bottom surface;

a circular area of resistive material on the top surface of said substrate, said circular area having a first resistive tongue portion extending from said circular area and contacting the transmission line, and a second resistive trace portion extending from the circular area and coupled to a second transmission line; and a metal ground region on the bottom surface of the substrate coupled to the second transmission line;

a DC blocking capacitor coupling the second transmission line to the metal ground region on the bottom surface of the substrate; and a current bias source connected to provide current to the first transmission line.

22. A dot termination, comprising:

a substrate having a top surface and a bottom surface, said substrate having a transmission line on the top surface;

a circular area of resistive material on the top surface of said substrate in connection with said transmission line;

a plurality of conductive ground vias extending from the top surface to the bottom surface of said substrate, the ground vias positioned about, and separated from, said circular area of resistive material; and a conductive ground trace for each of said plurality of ground vias, each conductive ground trace extending from a respective ground via toward said circular area of resistive material, wherein each conductive ground trace is physically separated a distance from each other said conductive ground trace.

* * * * *